US009808103B2

(12) United States Patent
Michaels et al.

(10) Patent No.: US 9,808,103 B2
(45) Date of Patent: Nov. 7, 2017

(54) EATING UTENSIL

(71) Applicant: B.BOX FOR KIDS DEVELOPMENTS PTY LTD, Malvern East, Victoria (AU)

(72) Inventors: Dannielle Lisa Michaels, Malvern East (AU); Monique Miriam Filer, Malvern East (AU)

(73) Assignee: B.BOX FOR KIDS DEVELOPMENTS PTY LTD, Mulgrave, Victoria (AU)

( * ) Notice: Subject to any disclaimer, the term of this patent is extended or adjusted under 35 U.S.C. 154(b) by 0 days.

(21) Appl. No.: 14/897,010

(22) PCT Filed: Jun. 6, 2014

(86) PCT No.: PCT/AU2014/050064
§ 371 (c)(1),
(2) Date: Dec. 9, 2015

(87) PCT Pub. No.: WO2014/197946
PCT Pub. Date: Dec. 18, 2014

(65) Prior Publication Data

US 2016/0106244 A1 Apr. 21, 2016

(30) Foreign Application Priority Data

Jun. 13, 2013 (AU) ..... 2013206314

(51) Int. Cl.
*A47G 21/04* (2006.01)
*A47G 21/02* (2006.01)

(52) U.S. Cl.
CPC ..... *A47G 21/04* (2013.01); *A47G 21/02* (2013.01)

(58) Field of Classification Search
CPC ..... A47G 21/04; A47G 21/02; A47J 43/284
USPC ..... 30/129, 322
See application file for complete search history.

(56) References Cited

U.S. PATENT DOCUMENTS 431,914 A * 7/1890 Plotts ..... A47G 21/04 30/324
D28,444 S * 4/1898 Richardson ..... 30/322
D35,313 S * 11/1901 Wirt ..... 601/137
1,638,956 A * 8/1927 Pinchbeck ..... A47J 17/04 30/113.3

(Continued)

FOREIGN PATENT DOCUMENTS

CN 1985720 6/2007
DE 3623531 A1 * 1/1988

(Continued)

OTHER PUBLICATIONS

International Search Report for PCT/AU2014/050064, Completed by the Australian Patent Office dated Jun. 19, 2014, 5 Pages.

(Continued)

*Primary Examiner* — Hwei C Payer
(74) *Attorney, Agent, or Firm* — Brooks Kushman P.C.

(57) ABSTRACT

A food utensil having a handle portion and a food engagement portion, the food engagement portion includes one or more member(s) disposed about the periphery of the food engagement portion, whereby the one or more member(s) define a food engagement region. The utensil is suitable for use by young children.

19 Claims, 3 Drawing Sheets

(56) References Cited

U.S. PATENT DOCUMENTS 2,576,388 A * 11/1951 Claflin ..... A61J 7/0023 16/430
2,724,894 A * 11/1955 La Tour ..... A47G 21/04 30/324
3,083,458 A * 4/1963 Tarson ..... A47G 21/023 30/322
3,086,286 A * 4/1963 Faller ..... A47J 17/04 30/123.7
3,121,951 A * 2/1964 Green ..... A47G 21/02 30/149
3,138,871 A * 6/1964 Sears ..... A47G 21/02 30/150
D236,069 S * 7/1975 Braid ..... 294/55.5
4,215,471 A * 8/1980 Schaefer ..... B26B 27/00 30/147
5,119,563 A * 6/1992 Willner, Jr. ..... A47G 21/026 30/322
5,167,070 A * 12/1992 Hirzel ..... A47G 21/023 30/322
5,479,708 A * 1/1996 Thomas ..... A47G 21/02 30/122
5,920,993 A * 7/1999 Wenk ..... A47G 21/02 30/324
6,536,114 B2 * 3/2003 Lawless ..... A47J 43/28 30/120.1
6,536,118 B1 * 3/2003 Campbell ..... A47J 43/283 294/26
6,701,625 B1 * 3/2004 Thomason ..... A47G 21/04 30/324
D498,990 S * 11/2004 White ..... D7/692
D547,145 S * 7/2007 Shan ..... D8/13
D568,696 S * 5/2008 Seidenfaden ..... D7/653
7,395,602 B2 * 7/2008 Backus ..... A47J 43/283 294/26
D582,227 S * 12/2008 Wong ..... D8/13
D614,818 S * 4/2010 Moore ..... D30/158
D740,623 S * 10/2015 Schiffman ..... D7/667
2006/0027064 A1 * 2/2006 Panik ..... A47G 21/02 83/13
2006/0253054 A1 * 11/2006 Wright ..... A61H 7/003 601/137
2009/0019708 A1 * 1/2009 Nazarian ..... A47G 21/004 30/322
2009/0126198 A1 * 5/2009 Hsu ..... B25G 1/02 30/123
2009/0217532 A1 9/2009 Cantu
2013/0125402 A1 5/2013 Chubenko et al.
2016/0106244 A1 * 4/2016 Michaels ..... A47G 21/04 30/150

FOREIGN PATENT DOCUMENTS

FR 452199 * 5/1913
FR 34359 * 6/1929
GB 2 122 875 A * 1/1984
GB 2 167 941 A * 6/1986
WO WO 2013/121575 A1 * 8/2013

OTHER PUBLICATIONS

Written Opinion for PCT/AU2014/050064, Completed by the Australian Patent Office, dated Jun. 19, 2014, 5 Pages.

* cited by examiner

EATING UTENSIL

CROSS-REFERENCE TO RELATED APPLICATIONS

This application is the U.S. national phase of PCT Application No. PCT/AU2014/050064 filed on Jun. 6, 2014, which claims priority to AU Patent Application No. 2013206314 filed on Jun. 13, 2013, the disclosures of which are incorporated in their entirety by reference herein.

FIELD OF THE INVENTION

The present invention relates to eating utensils, including eating utensils for use by young children.

BACKGROUND TO THE INVENTION

It is well accepted in the art that children have difficulties in using cutlery. Use of a spoon is typically mastered first, however the adept handling of food with a fork is more challenging and can take some time to accomplish.

In particular, children have difficulties on adequately spearing and retaining food on a fork. Often, the food is pushed about the plate for some time before adequate engagement with food item is achieved. This may significantly delay consumption of the meal, with the child often losing interest in the food as it cools. On some occasions, the child simply looses the resolve to chase the meal about the plate and demands more easily consumed food from the patent, such as a snack food.

To overcome these issues, parents and carer's often feed a child. However, this is time consuming and diminishes the child's confidence and progress in mastering the use of cutlery.

A further problem is that even where the child is able to adequately engage a food portion on fork, there can be difficulty in depositing the food into the mouth. Some children have difficulty in rotating a fork inwardly, as required to directly approach the mouth. Often, the fork approaches the mouth at an oblique angle leading to an unacceptably high rate of failure in depositing all food into the mouth.

Yet another problem with prior art utensils relates to difficulties in inserting the utensil with attached food into the mouth. Children's mouths are relatively small, and adult-sized utensils often do not fit. While the prior art provides miniature utensils for children, these utensils still have the problems of food engagement (as described supra). Furthermore, these miniature utensils have trouble in handling decent sized food portions. Again, this can make eating slow with the danger of loss of interest.

Prior art forks may also be inherently dangerous being capable of inflicting puncture wounds and lacerations if pushed against the skin or thrown at a person nearby. This is a problem not only with children, but in situations where the use of conventional forks is contraindicated such as on aircraft or institutions such as prisons.

The problems and difficulties referred to supra may also apply to the elderly, infirm, and persons having medical conditions such motor disorders or mental retardation.

It is an aspect of the present invention to provide a fork-like cutlery utensil that is more easily useable by young children, and others having difficulties in using conventional cutlery or in situations where conventional cutlery presents a danger.

A further problem is that children have difficulties in handling a fork and a spoon.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each provisional claim of this application.

SUMMARY OF THE INVENTION

After considering this description it will be apparent to one skilled in the art how the invention is implemented in various alternative embodiments and alternative applications. However, although various embodiments of the present invention will be described herein, it is understood that these embodiments are presented by way of example only, and not limitation. As such, this description of various alternative embodiments should not be construed to limit the scope or breadth of the present invention. Furthermore, statements of advantages or other aspects apply to specific exemplary embodiments, and not necessarily to all embodiments covered by the claims.

Throughout the description and the claims of this specification the word "comprise" and variations of the word, such as "comprising" and "comprises" is not intended to exclude other additives, components, integers or steps.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may.

The present invention is predicated at least in part on Applicant's finding that solid food, or substantially solid food can be manipulated by a cutlery utensil that is devoid of the splines of a traditional fork. It is proposed that food may be manipulated with a utensil having one or more members. Accordingly, in a first aspect the present invention provides a food utensil comprising a handle portion and a food engagement portion, the food engagement portion comprising one or more member(s) disposed about the periphery of the food engagement portion, whereby the one or more member(s) define a food engagement region. It has been found that by pushing the utensil into a food mass, the food mass is retained within the food engagement region as formed by the member(s). The food is then easily releasable into the user's mouth by a sucking motion or by using the tongue.

The present invention is a significant departure from a prior art fork which requires a user to pierce a food mass with the splines. This piercing action is difficult for young children, and requires dexterity in aiming at the centre of the food mass, and also strength to advance the splines into the food. By contrast, the present utensil is configured such that the members guide the food mass into a region where the food is retained by frictional engagement with the members, optionally assisted by engagement with a piercing element disposed within the region. Thus, the child is able to generally advance the utensil toward the desired food mass without so much attention to aiming the miniscule ends of the splines with the food. Furthermore, the child is not required to coordinate the acts of aiming the utensil and piercing in order to successfully retain the food.

To further facilitate understanding of the invention, reference is now made to the preferred embodiment shown in FIG. 1, having a handle portion 2, a food engagement portion 4, and members 6, defining a food engagement region 8 interior to the members 6.

In one embodiment of the utensil, at least one of the one or more member(s) is/are elongate and/or substantially flat and/or broad. Broad member(s) extending outwardly (i.e. away from the handle portion) facilitate the definition of a food engagement region of reasonable volume. Furthermore a broad inner face of the members (i.e. the face directed toward the food engagement region) act to improve frictional engagement of food within the food engagement region.

In one embodiment of the utensil, at least of the one or more members is blunt. While still capable of engaging food, the member(s) of the present invention are not required to be pointed or sharp as for traditional fork splines. This is of advantage to children, who are known to injure their gums, tongue, or wall of the buccal cavity with fork splines when introducing food into the mouth. Moreover, the use of blunt members provides for a utensil that cannot be used as a weapon of any type. In one embodiment, the terminus of the at least one of the one or more members is rounded.

In one embodiment of the utensil the members are played outwardly. By this arrangement, the members define a substantially funnel-shaped food engagement region whereby a volume of a food mass is pushed into a narrowing region thereby forcing the food against the inner face(s) of the member(s). This assists in the frictional engagement of the food within the food engagement area, and lessens the opportunity for food to drop back onto the plate before entering the mouth.

The present utensil may comprise any suitable number of members. In one embodiment, only a single member is present. In this embodiment, the member is substantially continuous about the perimeter of the food retaining region. While this embodiment undoubtedly possesses utility, there may be some difficulty experienced in liberating any retained food within the mouth. Sucking the food engagement portion may lead to formation of a suction within the food retaining region. Moreover, there may be some difficulty in the tongue being used to liberate food. Accordingly, in one embodiment, the single member is scalloped (or otherwise undulating) at the distal edge thereby providing improved access for the tongue, and also prevent the formation of a suction.

In one embodiment of the utensil two members are provided, with two gaps being formed between the two members. The two members will typically be sufficiently wide such that the so-formed gaps are not so great that food is not easily retained. Preferably, the members are dimensioned substantially equally. Moreover, the gaps are preferably dimensioned substantially equally.

In one embodiment of the utensil, three members are provided, with three gaps being formed between the three members. The three members will typically be sufficiently wide such that the so-formed gaps are not so great that food is not easily retained. Preferably, the members are dimensioned substantially equally. Moreover, the gaps are preferably dimensioned substantially equally.

In one embodiment of the utensil, four members are provided, with four gaps being formed between the four members. The four members will typically be sufficiently wide such that the so-formed gaps are not so great that food is not easily retained. Preferably, the members are dimensioned substantially equally. Moreover, the gaps are preferably dimensioned substantially equally.

In some embodiments (and particularly where three or four members are provided) the gaps between the members are wider than the members. Member width and gap width may be measured at any distance from the base of the food retaining region.

Embodiments having wider gaps allow for greater ease in liberating food within the mouth. Conversely, such embodiments may have a decreased ability in retaining food. Having benefit of the disclosure of the present specification, it is well within the ability of the skilled person to adapt the number and dimensions of the members and so-formed gaps for any given circumstance.

The width of one of the one or more member(s) will typically be less than about 10 mm (when measured at the broadest level), and in some embodiments is less than about 9, 8, 7, 6, 5, 4, 3, or 2 mm. Preferably (and particularly for an embodiment having three members) member width is between about 5 and 6 mm.

The length of one of the one or more member(s) will typically be less than about 20 mm (when measured from the base of the food retaining region), and in some embodiments is less than about 19, 18, 17, 16, 15, 14, 13, 12, 11, 10, 9, 8, 7, 6 or 5 mm. Preferably member length is between about 14 and 15 mm.

The thickness of one of the one or more member(s) will typically be less than about 2.5 mm (when measured at or toward the terminus) and in some embodiments is less than about 2.4, 2.3. 2.2, 2.1, 2, 1.9, 1.8, 1.7, 1.6, 1.5, 1.4, 1.3, 1.2, 1.1, 1, 0.9. 0.8, 0.7. 0.6 or 0.5 mm.

Preferably member length is between about 14 and 15 mm. It is contemplated that the member thickness may be significantly greater than that at or toward the terminus for mechanical and/or functional reasons.

In one embodiment of the utensil at least one of the one or more members is configured to be resilient deformable by virtue of structure and/or material of fabrication. Such embodiments are advantageous for retaining larger food masses which might otherwise not be admissible into the food retaining region. Thus, the deformability may allow for the members to deflect outwardly to fully enclose the food mass when the utensil is pushed against the mass. The resilient characteristic may then act to urge the members against the food mass, thereby retaining it more firmly as compared with members that are not resilient.

One embodiment of the utensil comprises one or more piercing elements adapted to pierce a food mass. This embodiment provides advantage where the food mass is not easily retainable by a utensil having member(s) only. For example, food masses that are relatively small firm may not be efficiently retained with insufficient frictional engagement being provided by the members. In these circumstances, the members may act to guide the food mass into the food engagement region wherein it is pierced (and retained by the piercing element). Typically, a single piercing element is disposed as toward the centre of the food retaining region, and emanating from the base.

In one embodiment, at least one of the one or more piercing element(s) terminate(s) below that of at least one of the one or more members. Advantageously, the piercing element(s) and (members) are arranged such that contact of the piercing element with the user is prevented, or at least the opportunity is diminished.

To improve safety further, in some embodiments the piercing element is substantially conical or frustoconical thereby avoiding any sharp point or edge.

The length of one of the one or more piercing element(s) will typically be less than about 15 mm (when measured from the base of the food retaining region), and in some embodiments is less than about 14, 13, 12, 11, 10, 9, 8, 7, 6, or 5 mm. Preferably element length is between about 9 and 10 mm.

The handle portion and food engagement portion may be disposed in any operable manner relative to each other, and may in some embodiments comprise an intervening neck region. In one embodiment, an axis of the food engagement portion forms an angle with an axis of the handle portion. Applicant has discovered that use of the utensils by children is facilitated where an angle of between about 20 degrees and about 40 degrees is formed. In some embodiments, the angle formed is at least about 20, 21, 22, 23, 24, 25, 26, 27, 28, 29, 30, 31, 32, 33, 34, 35, 35, 37, 38, 39 and 40 degrees. The axis may be formed greater advantage is provided where the angle is about 35 degrees, and particularly so for embodiments of the utensil having three or four members.

In one embodiment, the utensil is dimensioned so as to be usable by an infant, a toddler or a young child. Use is facilitated where the food engagement region is dimensioned so as to comfortably fit into the buccal cavity. The width of the food engagement region will typically be less than about 20 mm (when measured at the broadest level), and in some embodiments is less than about 19, 18, 17, 16, 15, 14, 13, 12, 11, 10, 9, 8, 7, 6, or 5 mm. Preferably the food engagement width is between about 13 and 14 mm.

The handle portion is also preferably dimensioned to facilitate use, with the width being between about 8 mm and about 25 mm (when measured at the broadest level). In some embodiments, the width of the handle portion is less than about 24, 23, 22, 21, 20, 19, 18, 17, 16, 15, 14, 13, 12, 11, 19 or 9 mm. Preferably, the handle portion width is between about 11 to about 21 mm (as the broadest dimension), or between about 10 and about 17 mm (as the narrowest dimension).

The present utensil may be fabricated form any suitable material, the suitability of any material being apparent to the skilled person having the benefit of the instant specification, and in light of the varying structural and function requirements detailed herein. Typically, the utensil is fabricated from a plastic by injection molding or other suitable technique from commercially-available material such as thermo plastic polyurethane (TPU); ionomer resin; ethylene vinyl acetate (EVA); thermo plastic styrenics (TPS); melt processible rubber (MPR); thermo plastic vulcanate (TPV); thermo plastic olefin (TPO); thermo plastic ester elastomer (TPEE); thermo plastic elastomer (TPE); thermoplastic rubber (TPR); polypropylene (PP), polyethylene terephthalate (PET), polyvinyl chloride (PVC); acrylonitrile-butadiene-styrene terpolymer (ABS); a polycarbonate and acrylonitrile-butadiene-styrene copolymer blend (PC/ABS); flexible plastic such as polystyrene sheet or polymethylmethacrylate (PMMA, marketed as "PERSPEX" by ICI Acrylics, Inc.); other acrylics; metal (e.g., stainless steel, aluminium, copper); wood; or any combination thereof. Other suitable materials and forming methods will be apparent to those skilled in the art. It is preferred that the utensil is fabricated from food grade material(s) and be devoid of PVC, a phthalate or bisphenol-A.

BRIEF DESCRIPTION OF THE DRAWINGS

The present invention may be more fully described or clearly ascertained by reference to the accompanying drawings which show a number of preferred embodiments, and in which.

DETAILED DESCRIPTION OF PREFERRED EMBODIMENTS

Figure 1:
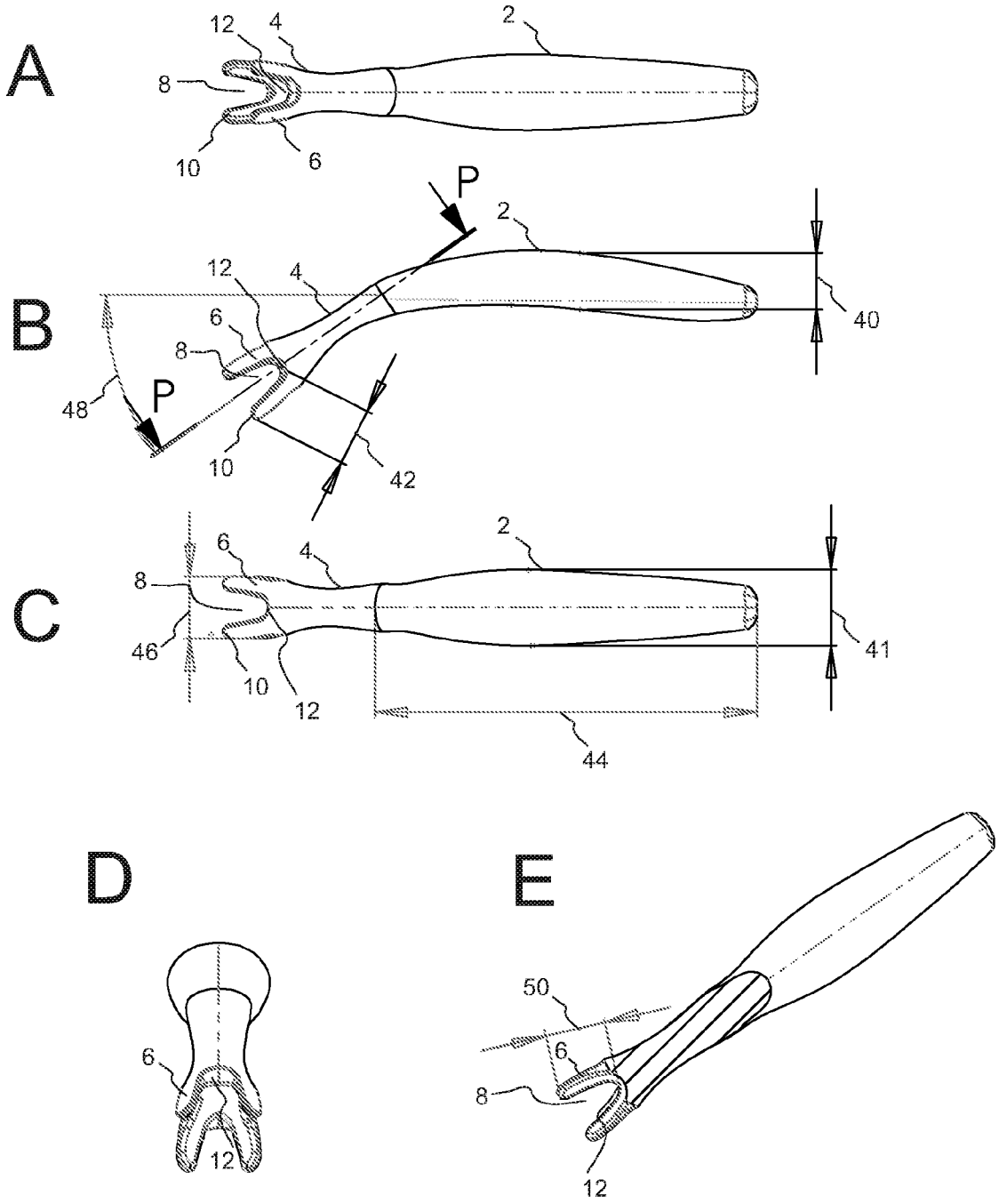
FIG. 1 shows drawings of a utensil of the present invention having four members, and devoid of a piercing element.

Reference is now made to FIG. 1A which shows an inferior view of a utensil having a handle 2, a neck region 4, and four members 6. The members 6 define an area capable of retaining food 8. A lateral view of the utensil is shown in FIG. 1B showing a curvature defining an angle (as taken by reference to the axis of the head and the axis of the handle). A superior view is shown in FIG. 1C. Dimensions and angles as numbered are as follows 40, 10.6 mm; 41, 14.2 mm; 42, 10.7 mm, 48, 35 degrees; 44, 71.4 mm; 46, 11.7 mm.

In use, the utensil is held at the handle 2, with the members 6 being pushed at or into a food mass (not shown) such that the entire food mass (or at least a portion thereof) is caused to enter the region 8. It will be noted that all four members 6 are splayed slightly outwardly such that the region 8 is broader at the terminus of the members 10 and narrower at the base 12. By this arrangement food is pushed into the more narrow part of the region 8 thereby increasing the opportunity for frictional engagement of the food by the members 6 and the base 12 of the region 8.

FIG. 1D is a perspective view (enlarged with reference to FIGS. 1A to 1C) showing further detail of the members.

FIG. 1E is a sectional view through the line marked P-P on FIG. 1B showing the base 12 of the food engagement area 8.

Figure 2:
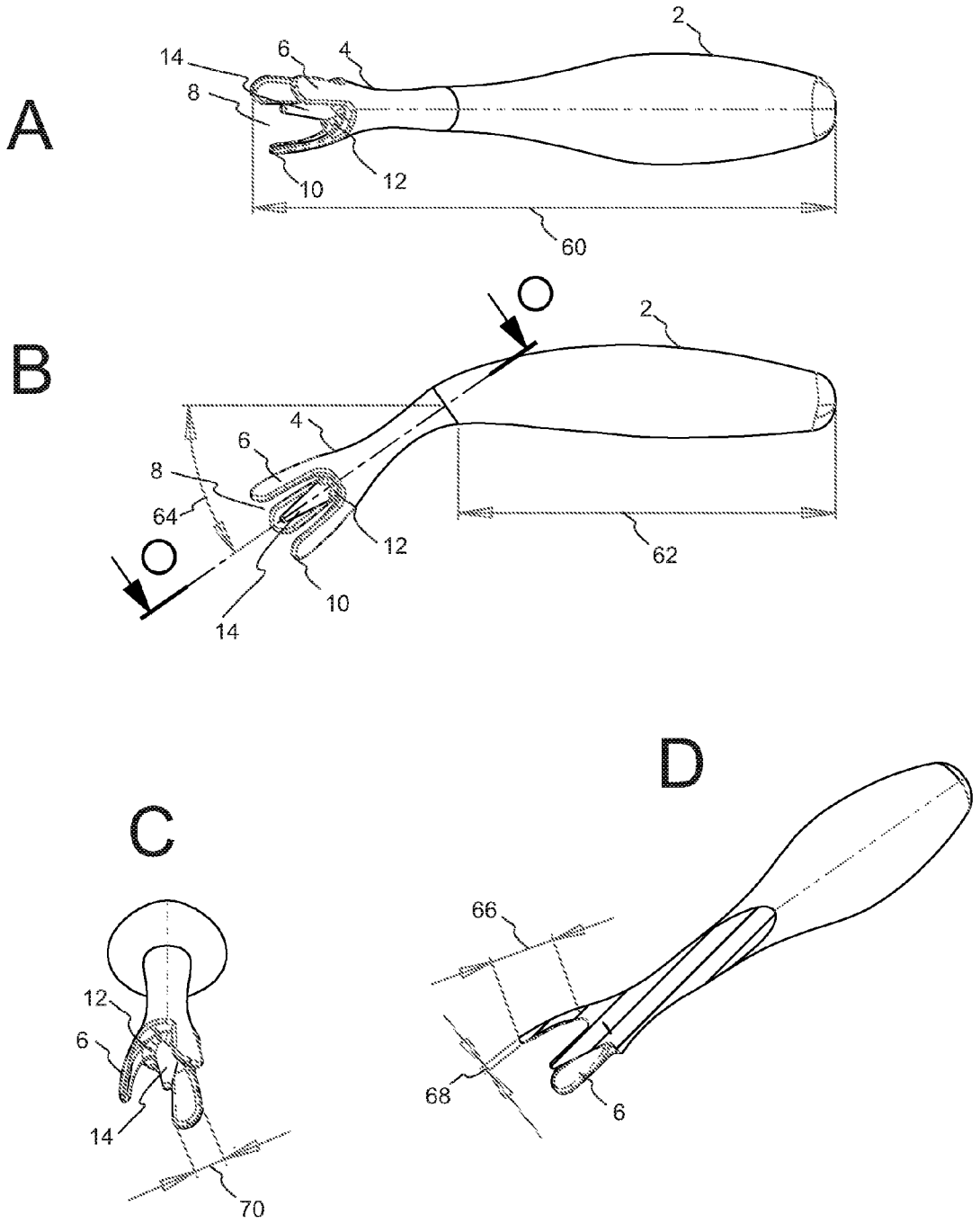
FIG. 2 shows drawings of a utensil of the present invention having three members and a single piercing element.

Reference is now made to FIG. 2 which components are numbered generally consistently with the embodiment of FIG. 1. FIG. 2A shows an inferior view of a utensil having 3 members 6 and a single piercing element 14. The utensil is used in a similar manner to that as described for FIG. 1, except that the food (if sufficiently solid) is pierced by the element 14.

It will be noted that the piercing element 14 terminates below the level of the terminus 10 of the members 6 in this embodiment. This allows for stabilization of the food mass by the members 6 before piercing with the element 14. It will be appreciated that piercing of food by children with a traditional fork requires skill in order to prevent the food from slipping across the plate when a piercing force is applied. The utensil of FIG. 2 requires a lower level of skill given the presence of the members 6 which only need be urged against the food to keep the food stationary on the plate, and therefore more easily pierced by the element 14. FIG. 2B is a lateral view demonstrated the angle 64 made by the food engagement portion 4 and the handle 2.

FIG. 2C is a perspective view of the food engaging portion 4, more clearly showing the centrality of the piercing element 14 with reference to the members 6.

Dimensions and angles as numbered in FIG. 2 are as follows: 60, 104.7 mm; 62, 67.7 mm; 64, 35 degrees; 66, 12.4 mm; 68, 1.3 mm; 70, 5.4 mm.

Figure 3:
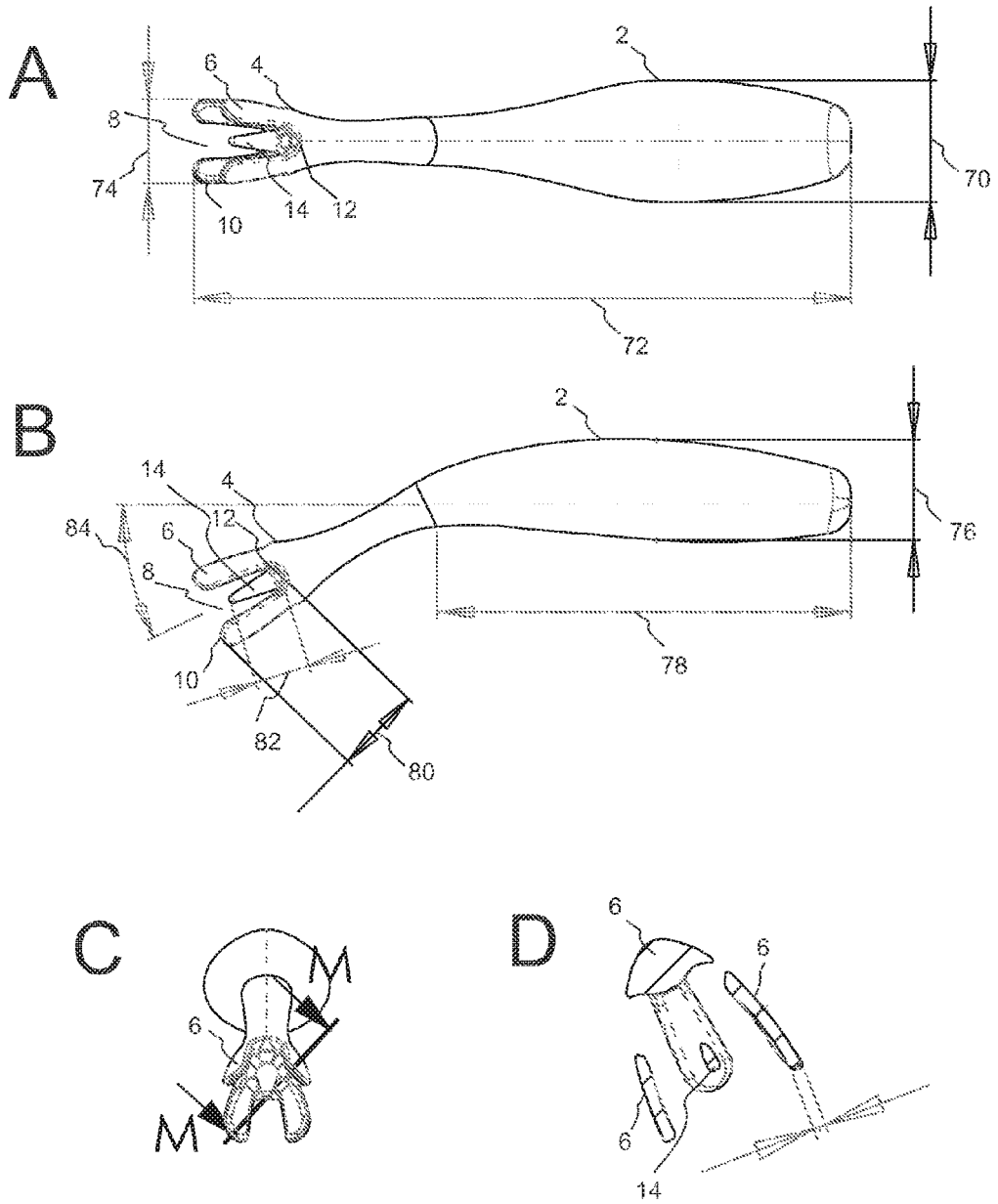
FIG. 3 shows drawings of a utensil of the present invention having four members and a single piercing element.

The components of FIG. 3 are numbered generally consistently with those of FIGS. 1 and 2. This embodiment includes four members 6 disposed about a central piercing element 14, as shown in the inferior view (FIG. 3A). This food engagement portion 4 in this embodiment forms a more shallow angle with the handle portion 2.

Greater detail of the food engagement portion is shown in the perspective view FIG. 3C, also by reference to FIG. 3D which is a section view through the line M-M of FIG. 3C.

Dimensions and angles as numbered in FIG. 3 are as follows: 70, 20.2 mm; 72, 108.3 mm; 74, 13.8 mm; 76, 16.6 mm; 78, 68.2 mm; 80, 14.4 mm; 82, 9.2 mm; 84, 26 degrees.

It is proposed that embodiments of the invention having 4 members provides superior control in the manipulation of food by the child, as compared with embodiments having 3 members or less. It will be noted that the rounded shape and small dimensions of the food retaining region of the 3- and 4-membered embodiments facilitates insertion into a child's mouth. By contrast, the food engagement regions of prior art forks are typically flat and wide, providing difficulty for some children in inserting into the mouth.

It is emphasized that any measurements provided in this specification are merely exemplary and should not be used in any manner to restrict the ambit of the present invention. Afforded the benefit of the disclosure of this specification the skilled person is enabled to alter the measurements by a matter of routine only to provide alternative embodiments. For example, while the exemplary measurements provided herein are directed to utensils for use by young children it would involve no more than routine modification of those measurements to confer usability for adults.

The invention may be said broadly to consist in the parts, elements and features referred to or indicated in the specification of the application, individually or collectively, in any or all combinations of two or more of said parts, elements or features. Wherein the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the invention and without diminishing its attendant advantages. It is therefore intended that such changes and modifications be included within the scope of the invention.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art.

The invention claimed is:

1. A food utensil comprising a handle portion and a food engagement portion, the food engagement portion comprising:

a base having a central region and an outer annular periphery;

one or more piercing elements projecting from the central region having a piercing tip;

three or more members disposed in a spaced apart arrangement about the annular periphery of the base of the food engagement portion, whereby the three or more members define a substantially funnel-shaped food engagement region therebetween and wherein the three or more members have blunt ends which extend beyond the one or more piercing elements and the three or more members can engage and stabilize a food item before it is pierced by the one or more piercing elements.

2. The food utensil of claim 1 wherein at least one of the three or more members is/are elongate.

3. The food utensil of claim 1 wherein at least one of the three or more members is/are splayed outwardly.

4. The food utensil of claim 1 wherein at least one of the three or more members is/are resiliently deformable.

5. The food utensil of claim 1 wherein the three or more members comprise at least four members.

6. The food utensil of claim 1 wherein the one or more piercing elements comprises one piercing element.

7. The food utensil of claim 6 wherein the one piercing element is centered within the funnel-shaped food engagement region.

8. The food utensil of claim 6 wherein the piercing element is disposed at or toward the central region of the base.

9. The food utensil of claim 6 wherein the one piercing element is conical or frustoconical.

10. The food utensil of claim 1 wherein the handle portion and the food engagement portion are relatively disposed such that an axis of the food engagement region forms an angle with an axis of the handle portion.

11. The food utensil of claim 10 wherein the angle is between about 20 degrees and 40 degrees.

12. The food utensil of claim 1 wherein the food engagement region has a width of less than 20 mm.

13. The food utensil of claim 1 comprising gaps between the three or more members disposed about the annular periphery of the base of the food engagement portion.

14. The food utensil of claim 13 wherein the gaps are dimensioned substantially equally.

15. The food utensil of claim 13 wherein the gaps are wider than the members.

16. The food utensil of claim 1 wherein the three or more members are spaced substantially equally about the annular periphery.

17. The food utensil of claim 16 wherein the three or more members are substantially flat and/or broad.

18. The food utensil of claim 1 wherein a terminus of at least one of the three or more members is/are rounded.

19. A food utensil comprising a handle portion and a food engagement portion, the food engagement portion comprising:

a base having a central region and an outer annular periphery;

one or more piercing elements projecting from the central region having a piercing tip;

three or more members disposed in a spaced apart arrangement about the annular periphery of the base of the food engagement portion, whereby the three or more members define a substantially funnel-shaped food engagement region therebetween and wherein the three or more members are substantially flat and/or broad having blunt ends which extend beyond the one or more piercing elements, and the three or more members can engage and stabilize a food item before it is pierced by the one or more piercing elements.

* * * * *